US010826173B2

(12) United States Patent
Maccabe

(10) Patent No.: US 10,826,173 B2
(45) Date of Patent: Nov. 3, 2020

(54) APERTURE FEED NETWORK WITH COMMON MODE REJECTION

(71) Applicant: BAE Systems Information and Electronic Systems Integration Inc., Nashua, NH (US)

(72) Inventor: Andrew Cannon Maccabe, Milford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 65 days.

(21) Appl. No.: 16/251,519

(22) Filed: Jan. 18, 2019

(65) Prior Publication Data

US 2020/0235466 A1 Jul. 23, 2020

(51) Int. Cl.

| | |
|---|---|
| ***H01Q 1/50*** | (2006.01) |
| ***H01Q 19/02*** | (2006.01) |
| ***H01Q 5/371*** | (2015.01) |
| ***H01Q 13/08*** | (2006.01) |
| ***H01Q 5/45*** | (2015.01) |
| ***H01Q 9/04*** | (2006.01) |
| ***H01Q 1/48*** | (2006.01) |

(52) U.S. Cl.

CPC ..... *H01Q 1/50* (2013.01); *H01Q 1/48* (2013.01); *H01Q 5/371* (2015.01); *H01Q 5/45* (2015.01); *H01Q 9/0485* (2013.01); *H01Q 13/08* (2013.01); *H01Q 19/025* (2013.01)

(58) Field of Classification Search

None

See application file for complete search history.

(56) References Cited

U.S. PATENT DOCUMENTS

| | | | | |
|---|---|---|---|---|
| 5,929,729 | A * | 7/1999 | Swarup | H01P 3/085 333/116 |
| 2003/0117325 | A1* | 6/2003 | Jo | H01Q 1/243 343/702 |
| 2006/0139118 | A1* | 6/2006 | Vaughn | H01P 1/387 333/1.1 |

(Continued)

OTHER PUBLICATIONS

Lu, et. al, "A Double Dipoles per Cell Structure for Solving Common-mode Resonance in Tightly Coupled Dipole Array," IEEE, 2016. 3 pages.

(Continued)

*Primary Examiner* — Crystal L Hammond

(74) *Attorney, Agent, or Firm* — Finch & Maloney PLLC; Scott J. Asmus

(57) ABSTRACT

An aperture feed network includes a substrate having a first surface and a parallel second surface, first and second conductive traces on the first surface of the substrate, a third conductive trace on the second surface of the substrate, a conductive via extending through a thickness of the substrate, and one or more ground plane structures on the second surface of the substrate. The substrate comprises a dielectric material. The first and second conductive traces together form a differential signal line. The third conductive trace comprises a first branch and a second branch. The conductive via contacts the first branch of the third conductive trace on the second surface of the substrate and the second conductive trace on the first surface of the substrate. The one or more ground plane structures have irregular shapes.

20 Claims, 5 Drawing Sheets

(56) References Cited

U.S. PATENT DOCUMENTS

| | | | | |
|---|---|---|---|---|
| 2010/0231464 | A1* | 9/2010 | Huang | H01Q 5/378 343/702 |
| 2011/0156963 | A1* | 6/2011 | Rajgopal | H01P 1/203 343/702 |
| 2017/0317422 | A1* | 11/2017 | Grando | H01P 5/10 |
| 2018/0342789 | A1* | 11/2018 | Jiang | H01Q 15/0013 |
| 2020/0014121 | A1* | 1/2020 | Maccabe | H01Q 21/061 |

OTHER PUBLICATIONS

Boryssenko, Anatoliy and Tom Goodwin, "Broadband Antenna Array Aperture Made of Tightly Couple Printed Dipoles," IEEE, 2016. 6 pages.

* cited by examiner

APERTURE FEED NETWORK WITH COMMON MODE REJECTION

BACKGROUND

Wireless communication devices, such as handheld computing devices and wireless access points, include antennas. Feed networks may be used to convert between a differential feed to the antenna and a single input feed to signal conditioning circuitry. The feed networks may also perform impedance matching between the antenna and other components of the system. However, there are a number of non-trivial issues associated with feed networks.

BRIEF DESCRIPTION OF THE DRAWINGS

Features and advantages of embodiments of the claimed subject matter will become apparent as the following Detailed Description proceeds, and upon reference to the Drawings, in which:

Although the following Detailed Description will proceed with reference being made to illustrative embodiments, many alternatives, modifications, and variations thereof will be apparent in light of this disclosure.

DETAILED DESCRIPTION

As noted above, there are a number of non-trivial issues associated with feed networks. For instance, broadband apertures are typically bandwidth limited by their feed networks and tend to suffer from scan anomalies due to in-band common-mode resonances. Thus, aperture feed network designs are provided herein. In an embodiment, an aperture feed network includes a substrate having a first surface and a parallel second surface, first and second conductive traces on the first surface of the substrate, a third conductive trace on the second surface of the substrate, a conductive via extending through a thickness of the substrate, and one or more ground plane structures on the second surface of the substrate. The substrate comprises a dielectric material. The first and second conductive traces together form a differential signal line. The third conductive trace comprises a first branch and a second branch. The conductive via contacts the first branch of the third conductive trace on the second surface of the substrate and the second conductive trace on the first surface of the substrate. The one or more ground plane structures have irregular shapes. The presence of the irregularly shaped ground plane structures cause common mode rejection from the signals on the differential signal line. The common mode signals may be effectively removed via additional striplines that are resistively coupled to ground. Numerous variations and alternative embodiments will be appreciated in light of this disclosure.

RF System Overview

Figure 1:
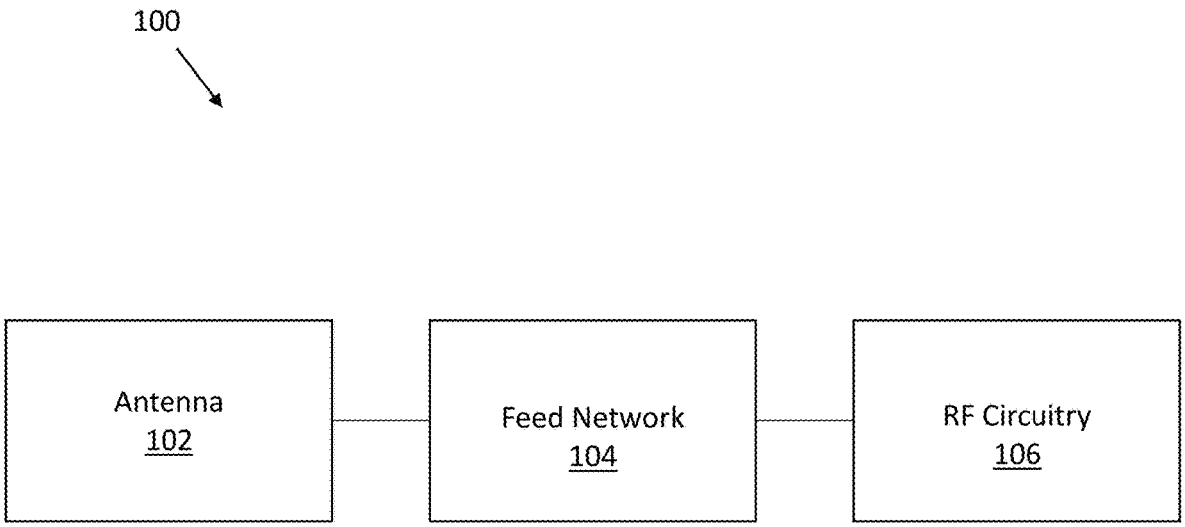
FIG. 1 illustrates a block diagram of a radio frequency (RF) system, in accordance with an embodiment of the present disclosure.

FIG. 1 illustrates an example RF system 100, according to an embodiment. RF system 100 includes an antenna 102, a feed network 104, and RF circuitry 106. In some cases, RF system 100 is a system-on-chip, or a chip set populated on a printed circuit board (PCB), although any number of implementations can be used. RF system 100 may be one portion of an electronic device that sends and/or receives RF signals. Examples of such electronic devices include a cell phone, a smart phone, a mobile internet device, a music player, a tablet computer, a laptop computer, a netbook computer, an ultrabook computer, a personal digital assistant (PDA), an ultra mobile personal computer, etc.), a desktop communication device, a server or other networked computing component, a printer, a scanner, a monitor, a set-top box, an entertainment control unit, a vehicle control unit, a digital camera, a digital video recorder, or a wearable communication device.

Antenna 102 may include one or more patch antennas or microstrip antennas, according to some embodiments. Any number of antennas may be included in antenna 102. In some embodiments, antenna 102 may include one or more antennas to support multiple communication bands (e.g., dual band operation or tri-band operation). For example, some of the antennas may support tri-band operation at 28 gigahertz, 39 gigahertz, and 60 gigahertz. Various ones of the antennas may support tri-band operation at 24.5 gigahertz to 29 gigahertz, 37 gigahertz to 43 gigahertz, and 57 gigahertz to 71 gigahertz. Various ones of the antennas may support 5G communications and 60 gigahertz communications. Various ones of the antennas may support 28 gigahertz and 39 gigahertz communications. Various ones of the antennas may support millimeter wave communications. Various ones of the antennas may support high band frequencies and low band frequencies.

Feed network 104 may include a differential signal line that couples to antenna 102 and a single signal line that couples to RF circuitry 106. According to some such embodiments, feed network 102 performs impedance matching between an output impedance of antenna 102 to an input impedance of RF circuitry 106 to maximize the signal transfer between antenna 102 and RF circuitry 106. For example, feed network 104 may provide impedance matching between a 100 Ohm input impedance associated with antenna 102 and a 50 Ohm input impedance associated with RF circuitry 106. Feed network 104 may couple any number of antennas to RF circuitry 106.

In an embodiment, feed network 104 includes patterned conductors on opposite sides of a dielectric substrate. The patterned conductors form conductive traces of various patterns, used to create different inductance paths and capacitance regions between conductors on both sides of the dielectric substrate. One or more resistors and/or other components (whether passive or active) may also be used to connect between different patterned conductors. The arrangement of patterned conductors, forming inductive and capacitive regions, and resistors determines the transmission line qualities of the feed network and its effectiveness at matching different impedances. Specific example embodiments of feed network 104 are described herein with reference to FIGS. 3 and 4.

RF circuitry 106 may include any number of circuits configured to at least one of filter, amplify, or modulate (or demodulate, as the case may be) in any way RF signals. RF circuitry 106 may also include digital-to-analog or analog-to-digital converters to convert RF signals to digital signals and vice-versa. Accordingly, RF circuitry can include any number of resistors, capacitors (e.g., decoupling capacitors), inductors, DC-DC converter circuitry, or other circuit elements. In some embodiments, RF circuitry may include a memory device programmed with instructions to execute beam forming, scanning, and/or codebook functions. In some embodiments, feed network 104 and RF circuitry 106 are provided on the same substrate or PCB. In some embodiments, feed network 104 is provided on a first substrate that is flip-chip bonded to a second substrate having RF circuitry 106. As will be appreciated, RF circuitry 106 may be configured as a transmitter, receiver, or transceiver, using standard or proprietary technology.

Aperture Feed Network Embodiments

Figure 2A:
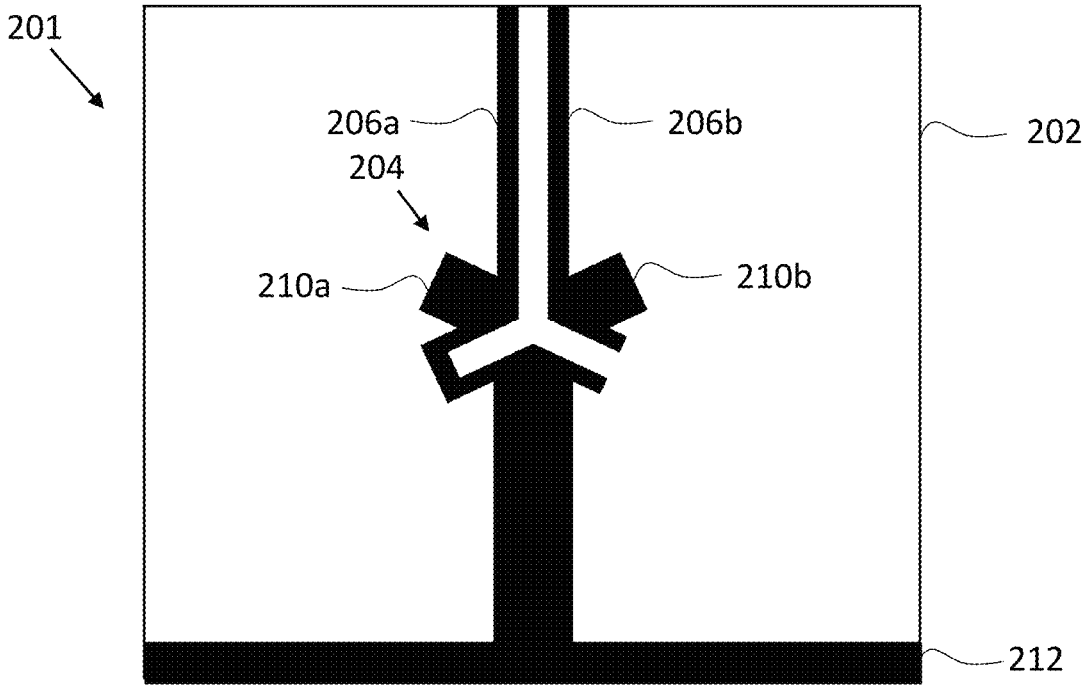
FIG. 2A illustrates a view of a first surface of a substrate having a feed network, in accordance with an embodiment of the present disclosure.
Figure 2B:
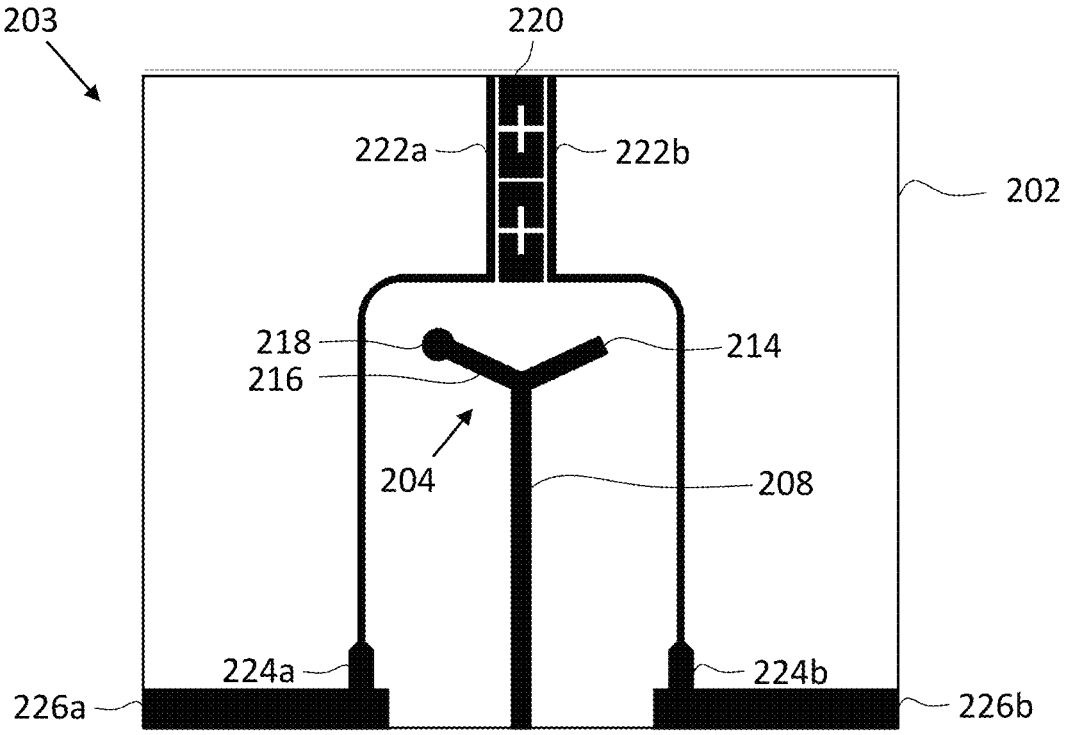
FIG. 2B illustrates a view of a second surface of the substrate having the feed network of FIG. 2A, in accordance with an embodiment of the present disclosure.

FIGS. 2A and 2B illustrate top-down views of a feed network comprising a first surface 201 and a second surface 203, respectively, of a substrate 202, according to an embodiment. First surface 201 and second surface 203 may be opposite, parallel sides of substrate 202. Each of first surface 201 and second surface 203 includes patterned conductive traces that form an impedance matching network and also provides common mode rejection of an RF signal, according to some embodiments. The illustrated aperture feed network of FIGS. 2A and 2B may be included within feed network 104.

Substrate 202 includes a dielectric material that may have a thickness between 0.5 mm and 1.5 mm. Any suitable dielectric material may be used (e.g., a laminate material). In some embodiments, the dielectric material may be an organic dielectric material, a fire-retardant grade 4 material (FR-4), bismaleimide triazine (BT) resin, polyimide materials, glass reinforced epoxy matrix materials, high-k dielectric, low-k or ultra low-k dielectric (e.g., carbon-doped dielectrics, fluorine-doped dielectrics, porous dielectrics, and organic polymeric dielectrics). The dielectric material may be silicon oxide or silicon nitride. A dielectric constant of the dielectric material used in substrate 202 may be between about 2.8 and about 3.2. Substrate 202 may also be a structure that includes multiple distinct layers of dielectric materials and/or other materials (e.g., insulators, semiconductors, conductors).

The conductive traces patterned on first surface 201 and second surface 203 of substrate 202 may be any conductive material, such as metal, conductive ink, or a conductive polymer. The traces and other patterned structures may be formed, for example, using standard lithography techniques, or ink-jet printing techniques, or 3-D printing techniques. Lift-off or etching techniques may be employed to form the various structures, according to some such embodiments. Example metals for the conductive traces include copper, gold, platinum, titanium, or aluminum.

According to an embodiment, the aperture feed network includes a double-Y balun structure 204 patterned on each of first surface 201 and second surface 203. Double-Y balun structure 204 includes a first conductive trace 206*a* and a second conductive trace 206*b* patterned on first surface 201 of substrate 202. Double-Y balun structure 204 includes a third conductive trace 208 patterned on second surface 203 of substrate 202. Third conductive trace 208 includes a first branch 214 and a second branch 216. First branch 214 and second branch 216 substantially align with a first wing structure 210*a* and a second wing structure 210*b*, respectively, patterned on first surface 201 of substrate 202. A conductive via (shown later in FIG. 3), extends through a thickness of substrate 202 to connect between an end portion 218 of second branch 216 and second wing structure 210*b*.

According to an embodiment, first conductive trace 206*a* and second conductive trace 206*b* together form a differential signal line that couples to one or more antenna structures in antenna 102. According to an embodiment, third conductive trace 208 provides a single-ended signal line that couples to RF circuitry 106. First conductive trace 206*a* may also be conductively coupled to a ground line 212. Ground line 212 may be coupled to a ground of the system.

Double-Y balun 204 converts signals between a differential I/O and a single-ended I/O. Furthermore, the widths and lengths of each of first conductive trace 206*a*, second conductive trace 206*b*, and third conductive trace 208, as well as the thickness of substrate 202 may all be chosen such that there is an impedance match between a first load (e.g., an antenna) coupled to differential signal lines 206*a*/206*b* and a second load (e.g., RF circuitry) coupled to third conductive trace 208. For example, double-Y balun 204 may be designed to match a 100 Ohm input impedance seen by first conductive trace 206*a* and second conductive trace 206*b* to a 50 Ohm input impedance seen by third conductive trace 208.

According to an embodiment, second surface 203 of substrate 202 also includes a plurality of ground plane structures 220. In some embodiments, ground plane structures 220 are substantially aligned with first conductive trace 206*a* and second conductive trace 206*b* patterned on first surface 201 of substrate 202. As used herein, structures are "substantially aligned" with one another if the structures at least partially overlap in the z-direction. Each of plurality of ground plane structures 220 may be separated from adjacent ground plane structures by a same distance. Although only four ground plane structures 220 are illustrated in FIG. 2B, any number of ground plane structures may be used.

According to an embodiment, one or more of ground plane structures 220 has an irregular shape. An irregular shape is any shape that is not either an oval, circle, square, rectangle, or triangle. In the illustrated example of FIG. 2B, each of ground plane structures 220 has a square shape with a notch removed from one side of the square to render the shape irregular. Any number of notches or extensions may be used to create any type of irregular shape. The type of irregular shape used for ground plane structures 220 may be chosen to provide improved impedance matching across a given frequency range, as well as providing efficient common-mode signal rejection across the same given frequency range.

Ground plane structures 220 may all be oriented in the same direction, such that the irregular features of each of ground plane structures 220 are all aligned in the same direction. In some other embodiments, different ones of ground plane structures 220 may be rotated such that the irregular features of each of ground plane structures 220 may point in different directions. In the example illustrated in FIG. 2B, adjacent ground plane structures are rotated 180 degrees with respect to each other.

According to an embodiment, one or more striplines 222*a* and 222*b* may be included adjacent to ground plane structures 220 on second surface 203 of substrate 202. In one example, striplines 222*a* and 222*b* are located on either side of ground plane structures 220 as illustrated in FIG. 2B.

Stripline 222*a* may extend around double-Y balun structure 204 to a resistor 224*a*. Resistor 224*a* may couple between stripline 222*a* and a ground line 226*a*. Similarly, stripline 222*b* may extend around double-Y balun structure 204 to a resistor 224*b*. Resistor 224*b* may couple between stripline 222*b* and a ground line 226*b*. Each of resistors 224*a* and 224*b* may be a surface mount resistor having a resistance between about 25 Ohms and about 50 Ohms. Ground lines 226*a* and 226*b* may each be connected to a system ground. Accordingly, in some embodiments, each of ground lines 212, 226*a*, and 226*b* are coupled together at a system ground. According to some embodiments, common mode signals (typically noise signals) found on both first conductive trace 206*a* and second conductive trace 206*b* are coupled to ground plane structures 220 and shorted out via striplines 222*a* and 222*b*.

Figure 3:
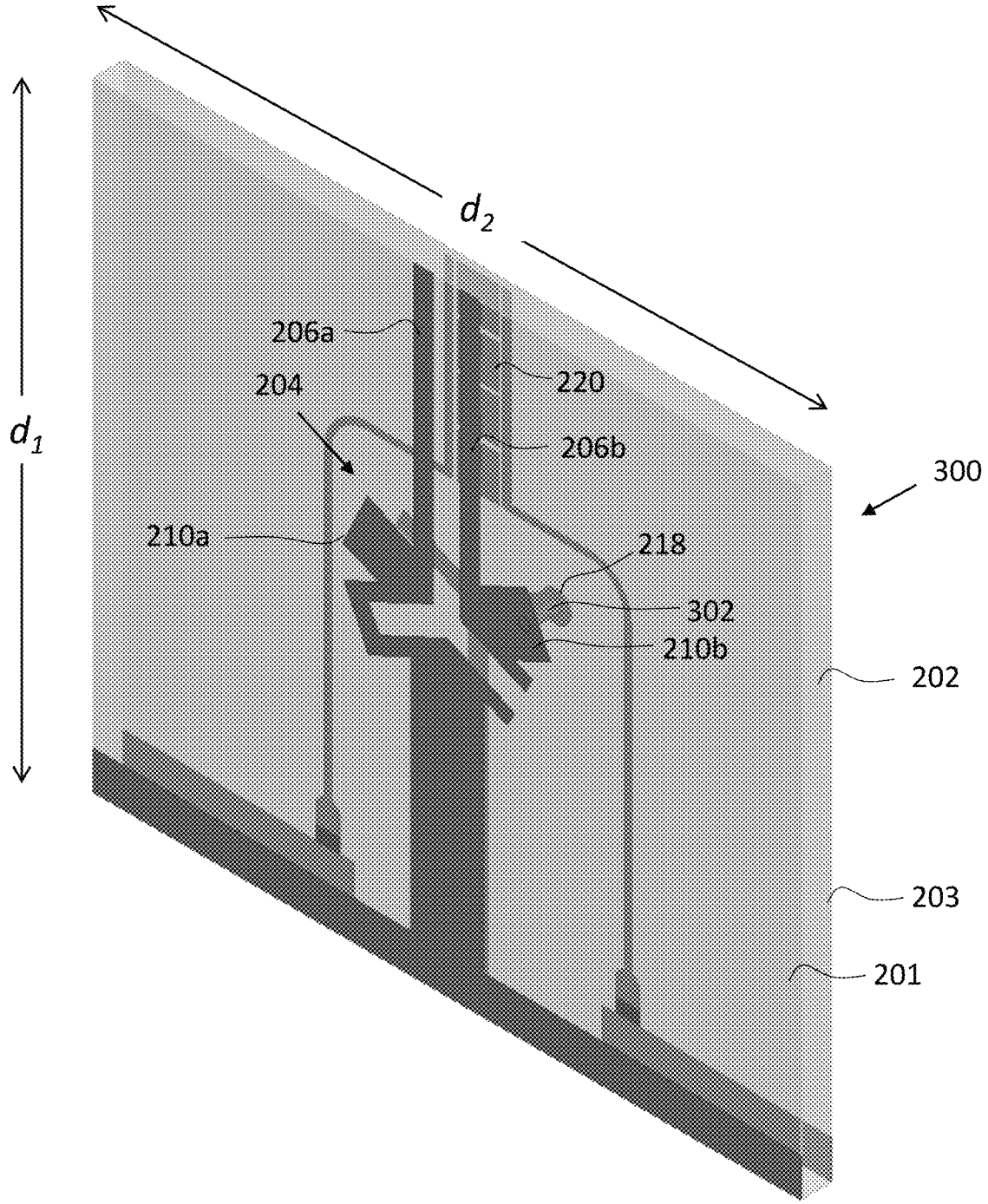
FIG. 3 illustrates a 3-D view of a feed network on a substrate, such as the one shown in FIGS. 2A-B, in accordance with an embodiment of the present disclosure.

FIG. 3 illustrates an isometric 3-D view of an aperture feed network 300 as previously illustrated in FIGS. 2A and 2B, according to an embodiment. First surface 201 and second surface 203 of substrate 202 are shown with one surface over the other (and substrate 203 being transparent) to demonstrate how the conductive traces on each of first surface 201 and second surface 203 align with one another. For example, ground plane structures 220 on second surface 203 are shown to be substantially aligned beneath first conductive trace 206*a* and second conductive trace 206*b* on first surface 201.

According to an embodiment, a conductive via 302 extends through a thickness of substrate 202 to connect second wing structure 210*b* on first surface 201 with end portion 218 on second surface 203. Conductive via 302 may be formed via conventional metal plating or sputtering techniques. In some embodiments, conductive via 302 comprises copper, tungsten, or aluminum. No via structures are used to connect wing structure 210*a* to any lower conductive traces. Accordingly, wing structure 210*a* may only be capacitively coupled to any lower conductive traces aligned with it on second surface 203 of substrate 202.

According to an embodiment, the general dimensions of aperture feed network 300 are relative to the operating RF bandwidth of the system. For example, each of dimensions $d_1$ and $d_2$ may be less than ½ the wavelength of the upper frequencies in the operating bandwidth. For example, if the system operated at frequencies between 3 GHz and 5 GHz, then each of $d_1$ and $d_2$ may be less than about 3 cm, as a 5 GHz, wave has a wavelength of about 6 cm. In one example, $d_1$ is between about 15 mm and about 30 mm, and $d_2$ is between about 20 mm and about 35 mm.

Although only a single aperture feed network 300 is illustrated, when used in an RF communication device, an array of such impedance matching networks 300 may be used to connect between one or more antennas and RF circuitry. Furthermore, one or more of the aperture feed networks 300 used in the array may have different physical sizes for matching different impedances or for use with different frequency bands.

Figure 4:
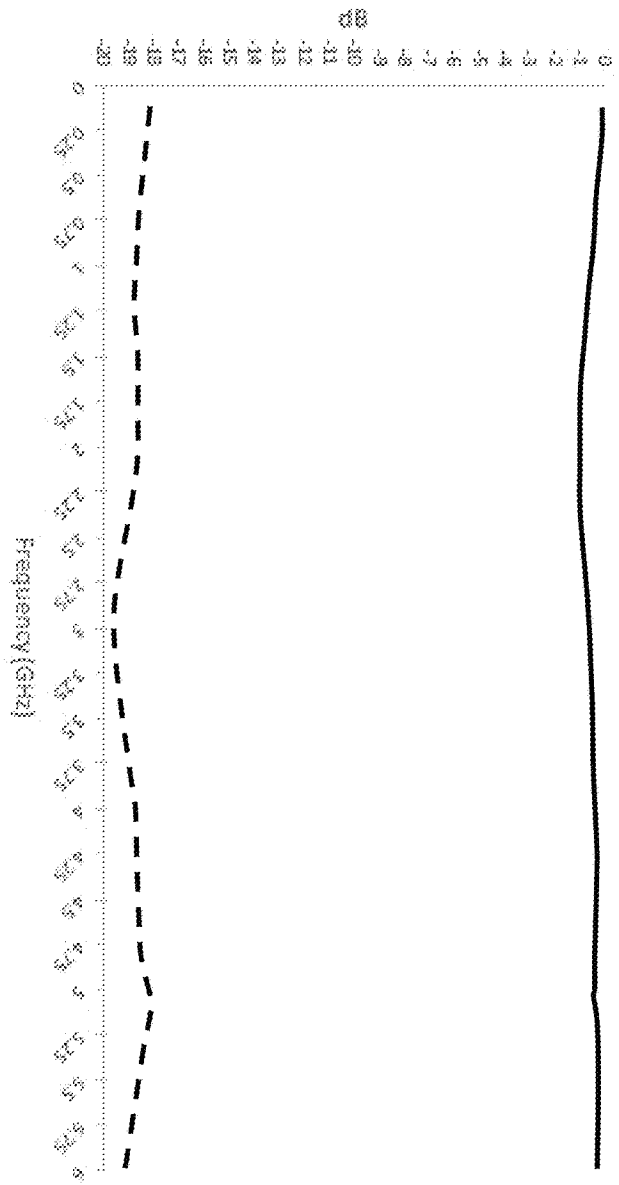
FIG. 4 provides simulated results of insertion loss and return loss for a feed network, in accordance with an embodiment of the present disclosure.

FIG. 4 illustrates simulated insertion loss (solid line) and return loss (dashed line) results for aperture feed network 300 across a large range of frequencies (0.125 GHz to 6 Ghz), according to an embodiment. Insertion loss through impedance matching network 300 remains very low (between 0 and −1 dB), thus nearly all power is delivered through the network across the entire simulated frequency bandwidth of about 6 GHz. The return loss demonstrates very low reflected power because of any impedance mismatches across the entire simulated frequency bandwidth of about 6 GHz. A general rule of thumb is that return loss less than about 8 dB is considered acceptable for most RF applications.

Example Communication Device

Figure 5:
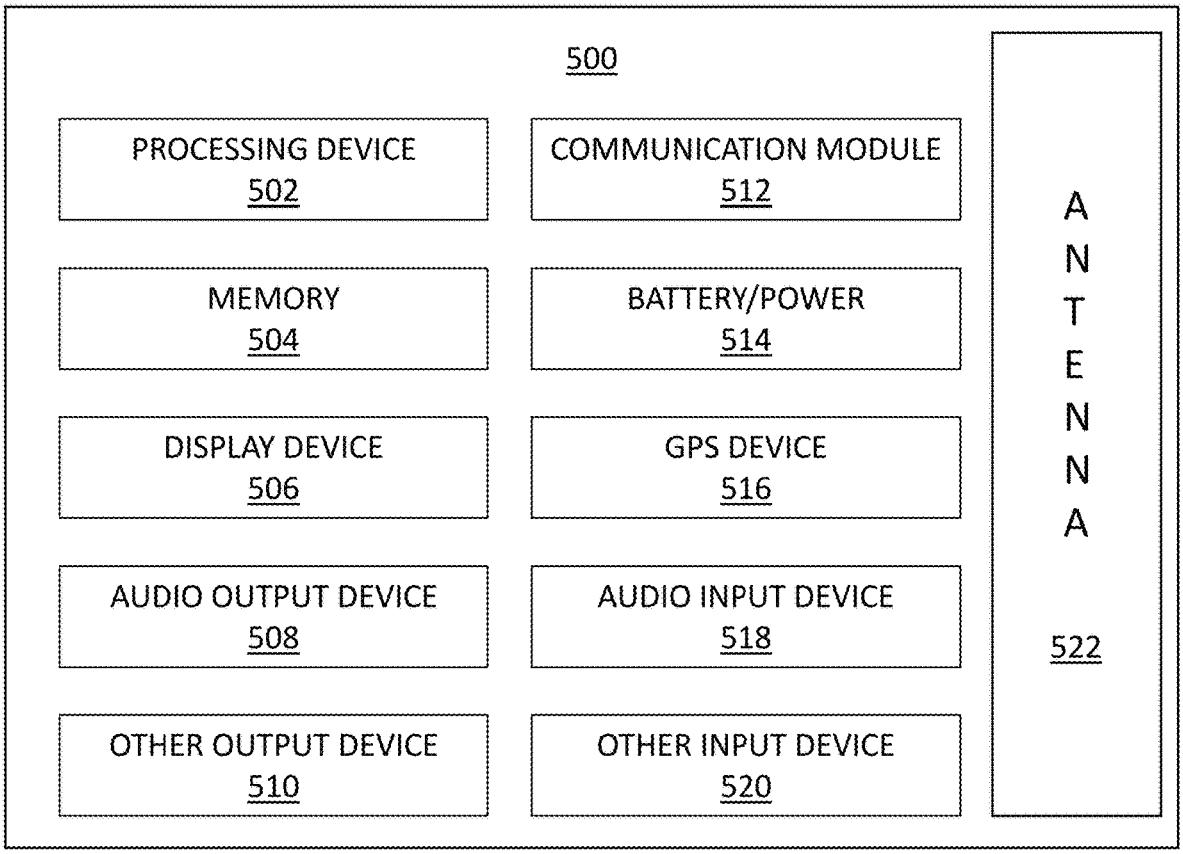
FIG. 5 illustrates a block diagram of an example communication device that may include an antenna module, in accordance with an embodiment of the present disclosure.

FIG. 5 is a block diagram of an example communication device 500 that may include one or more aperture feed networks, in accordance with any of the embodiments disclosed herein. Any suitable ones of the components of the communication device 500 may include an aperture feed network, as disclosed herein, when interfacing with antenna 522. A number of components are illustrated in FIG. 5 as included in the communication device 500, but any one or more of these components may be omitted or duplicated, as suitable for the application. In some embodiments, some or all of the components included in the communication device 500 may be attached to one or more motherboards. In some embodiments, some or all of these components are fabricated onto a single system-on-a-chip (SoC) die.

Additionally, in various embodiments, communication device 500 may not include one or more of the components illustrated in FIG. 5, but communication device 500 may include interface circuitry for coupling to the one or more components. For example, communication device 500 may not include a display device 506, but may include display device interface circuitry (e.g., a connector and driver circuitry) to which display device 506 may be coupled. In another set of examples, communication device 500 may not include an audio input device 518 or an audio output device 508 but may include audio input or output device interface circuitry (e.g., connectors and supporting circuitry) to which audio input device 518 or audio output device 508 may be coupled.

Communication device 500 may include a processing device 502 (e.g., one or more processing devices). As used herein, the term "processing device" or "processor" may refer to any device or portion of a device that processes electronic data from registers and/or memory to transform that electronic data into other electronic data that may be stored in registers and/or memory. Processing device 502 may include one or more digital signal processors (DSPs), application-specific integrated circuits (ASICs), central processing units (CPUs), graphics processing units (GPUs), cryptoprocessors (specialized processors that execute cryptographic algorithms within hardware), server processors, or any other suitable processing devices. Communication device 500 may include a memory 504, which may itself include one or more memory devices such as volatile memory (e.g., dynamic random access memory (DRAM)), nonvolatile memory (e.g., read-only memory (ROM)), flash memory, solid state memory, and/or a hard drive. In some embodiments, memory 504 may include memory that shares a die with processing device 502. This memory may be used as cache memory and may include embedded dynamic random access memory (eDRAM) or spin transfer torque magnetic random access memory (STT-MRAM).

In some embodiments, communication device 500 may include a communication module 512 (e.g., one or more communication modules). For example, communication module 512 may be configured for managing wireless communications for the transfer of data to and from communication device 500. The term "wireless" and its derivatives may be used to describe circuits, devices, systems, methods, techniques, communications channels, etc., that may communicate data through the use of modulated electromagnetic radiation through a nonsolid medium. The term does not imply that the associated devices do not contain any wires, although in some embodiments they might not.

Communication module 512 may implement any of a number of wireless standards or protocols, including but not limited to Institute for Electrical and Electronic Engineers (IEEE) standards including Wi-Fi (IEEE 802.11 family), IEEE 802.16 standards (e.g., IEEE 802.16-2005 Amendment), LTE project along with any amendments, updates, and/or revisions (e.g., advanced LTE project, ultra mobile broadband (UMB) project (also referred to as "3GPP2"), etc.). IEEE 802.16 compatible Broadband Wireless Access (BWA) networks are generally referred to as WiMAX networks, an acronym that stands for Worldwide Interoperability for Microwave Access, which is a certification mark for products that pass conformity and interoperability tests for the IEEE 802.16 standards. Communication module 512 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. Communication module 512 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). Communication module 512 may operate in accordance with Code Division Multiple Access (CDMA), Time Division Multiple Access (TDMA), Digital Enhanced Cordless Telecommunications (DECT), Evolution-Data Optimized (EV-DO), and derivatives thereof, as well as any other wireless protocols that are designated as 3G, 4G, 5G, and beyond. Communication module 512 may operate in accordance with other wireless protocols in other embodiments. Communication device 500 may include an antenna 522 to facilitate wireless communications and/or to receive other wireless communications (such as AM or FM radio transmissions).

In some embodiments, communication module 512 may manage wired communications, such as electrical, optical, or any other suitable communication protocols (e.g., the Ethernet). As noted above, communication module 512 may include multiple communication modules. For instance, a first communication module may be dedicated to shorter-range wireless communications such as Wi-Fi or Bluetooth, and a second communication module may be dedicated to longer-range wireless communications such as global positioning system (GPS), EDGE, GPRS, CDMA, WiMAX, LTE, EV-DO, or others. In some embodiments, the first communication module may be dedicated to wireless communications, and the second communication module may be dedicated to wired communications.

Communication device 500 may include battery/power circuitry 514. Battery/power circuitry 514 may include one or more energy storage devices (e.g., batteries or capacitors) and/or circuitry for coupling components of communication device 500 to an energy source separate from communication device 500 (e.g., AC line power).

Communication device 500 may include a display device 506 (or corresponding interface circuitry, as discussed above). Display device 506 may include any visual indicators, such as a heads-up display, a computer monitor, a projector, a touchscreen display, a liquid crystal display (LCD), a light-emitting diode display, or a flat panel display.

Communication device 500 may include an audio output device 508 (or corresponding interface circuitry, as discussed above). Audio output device 508 may include any device that generates an audible indicator, such as speakers, headsets, or earbuds.

Communication device 500 may include audio input device 518 (or corresponding interface circuitry, as discussed above). Audio input device 518 may include any device that generates a signal representative of a sound, such as microphones, microphone arrays, or digital instruments (e.g., instruments having a musical instrument digital interface (MIDI) output).

Communication device 500 may include a GPS device 516 (or corresponding interface circuitry, as discussed above). GPS device 516 may be in communication with a satellite-based system and may receive a location of communication device 500, as known in the art.

Communication device 500 may include an other output device 510 (or corresponding interface circuitry, as discussed above). Examples of other output device 510 may include an audio codec, a video codec, a printer, a wired or wireless transmitter for providing information to other devices, or an additional storage device.

Communication device 500 may include an other input device 520 (or corresponding interface circuitry, as discussed above). Examples of other input device 520 may include an accelerometer, a gyroscope, a compass, an image capture device, a keyboard, a cursor control device such as a mouse, a stylus, a touchpad, a bar code reader, a Quick Response (QR) code reader, any sensor, or a radio frequency identification (RFID) reader.

Communication device 500 may have any desired form factor, such as a handheld or mobile communication device (e.g., a cell phone, a smart phone, a mobile internet device, a music player, a tablet computer, a laptop computer, a netbook computer, an ultrabook computer, a personal digital assistant (PDA), an ultra mobile personal computer, etc.), a desktop communication device, a server or other networked computing component, a printer, a scanner, a monitor, a set-top box, an entertainment control unit, a vehicle control unit, a digital camera, a digital video recorder, or a wearable communication device. In some embodiments, the communication device 500 may be any other electronic device that processes data.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Other embodiments may be implemented as software executed by a programmable control device. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

FURTHER EXAMPLE EMBODIMENTS

The following examples pertain to further embodiments, from which numerous permutations and configurations will be apparent.

Example 1 is an aperture feed network. The aperture feed network includes a substrate having a first surface and a parallel second surface, first and second conductive traces on the first surface of the substrate, a third conductive trace on the second surface of the substrate, a conductive via extending through a thickness of the substrate, and one or more ground plane structures on the second surface of the substrate. The substrate comprises a dielectric material. The first and second conductive traces together form a differential signal line. The third conductive trace comprises a first branch and a second branch. The conductive via contacts the first branch of the third conductive trace on the second surface of the substrate and the second conductive trace on the first surface of the substrate. The one or more ground plane structures have irregular shapes.

Example 2 includes the subject matter of Example 1, wherein the one or more ground plane structures are substantially aligned on the opposite side of the substrate from the first conductive trace and the second conductive trace.

Example 3 includes the subject matter of Example 1 or 2, and further comprising one or more striplines on the second surface of the substrate, the one or more striplines being adjacent to the one or more ground plane structures.

Example 4 includes the subject matter of Example 3, wherein the one or more ground plane structures are provided between at least two of the striplines.

Example 5 includes the subject matter of Example 3, wherein at least one of the one or more striplines is coupled to a resistor.

Example 6 includes the subject matter of any one of Examples 1-5, wherein a portion of the second branch of the third conductive trace is substantially aligned on the opposite side of the substrate from the first conductive trace.

Example 7 includes the subject matter of any one of Examples 1-6, wherein the differential signal line is configured to feed into an antenna.

Example 8 includes the subject matter of any one of Examples 1-7, wherein an impedance at the third conductive trace is about 50 Ohms and an impedance at the differential signal line is about 100 Ohms.

Example 9 is an RF system. The RF system includes one or more antennas and an aperture feed network electrically coupled to the one or more antennas. The aperture feed network includes a substrate having a first surface and a parallel second surface, first and second conductive traces on the first surface of the substrate, a third conductive trace on the second surface of the substrate, a conductive via extending through a thickness of the substrate, and one or more ground plane structures on the second surface of the substrate. The substrate comprises a dielectric material. The first and second conductive traces together form a differential signal line. The third conductive trace comprises a first branch and a second branch. The conductive via contacts the first branch of the third conductive trace on the second surface of the substrate and the second conductive trace on the first surface of the substrate. The one or more ground plane structures have irregular shapes. The RF system also includes RF circuitry configured to one of or both filter and amplify an RF signal, wherein either the RF signal is received by the RF circuitry from the one or more antennas via the aperture feed network, or the filtered and/or amplified version of the RF signal is provided by the RF circuitry to the one or more antennas via the aperture feed network.

Example 10 includes the subject matter of Example 9, wherein the differential signal line is coupled to the one or more antennas and the third conductive trace is coupled to the RF circuitry.

Example 11 includes the subject matter of Example 9 or 10, wherein the one or more ground plane structures are substantially aligned on the opposite side of the substrate from the first conductive trace and the second conductive trace.

Example 12 includes the subject matter of any one of Examples 9-11, and further comprising one or more striplines on the second surface of the substrate, the one or more striplines being adjacent to the one or more ground plane structures.

Example 13 includes the subject matter of Example 12, wherein the one or more ground plane structures are provided between at least two of the striplines.

Example 14 includes the subject matter of Example 12, wherein at least one of the one or more striplines is coupled to a resistor.

Example 15 includes the subject matter of any one of Examples 9-14, wherein a portion of the second branch of the third conductive trace is substantially aligned on the opposite side of the substrate from the first conductive trace.

Example 16 includes the subject matter of any one of Examples 9-15, wherein an impedance at the third conductive trace is about 50 Ohms and an impedance at the differential signal line is about 100 Ohms.

Example 17 is an impedance matching structure. The impedance matching structure includes first and second conductive traces on a first surface of a substrate, a third conductive trace on a second surface of the substrate opposite to the first surface of the substrate, a conductive via extending through a thickness of the substrate, one or more ground plane structures on the second surface of the substrate, and one or more striplines on the second surface of the substrate. The first and second conductive traces together form a differential signal line. The third conductive trace comprises a first branch and a second branch. The conductive via contacts the first branch of the third conductive trace on the second surface of the substrate and the second conductive trace on the first surface of the substrate. The one or more striplines are adjacent to the one or more ground plane structures.

Example 18 includes the subject matter of Example 17, wherein the one or more ground plane structures are substantially aligned on the opposite side of the substrate from the first conductive trace and the second conductive trace.

Example 19 includes the subject matter of Example 17 or 18, wherein the one or more ground plane structures comprise ground plane structures with irregular shapes.

Example 20 includes the subject matter of any one of Examples 17-19, wherein the one or more ground plane structures are provided between at least two of the striplines.

Example 21 includes the subject matter of any one of Examples 17-20, wherein at least one of the one or more striplines is coupled to a resistor.

Example 22 includes the subject matter of any one of Examples 17-21, wherein a portion of the second branch of the third conductive trace is substantially aligned on the opposite side of the substrate from the first conductive trace.

Example 23 includes the subject matter of any one of Examples 17-22, wherein an impedance at the third conductive trace is about 50 Ohms and an impedance at the differential signal line is about 100 Ohms.

What is claimed is:

1. An aperture feed network, comprising:

a substrate having a first surface and a second surface, the substrate comprising a dielectric material, wherein the second surface of the substrate is opposite and parallel to the first surface of the substrate;

a first conductive trace on the first surface of the substrate, and a second conductive trace on the first surface of the substrate, wherein the first conductive trace and the second conductive trace together form a differential signal line;

a third conductive trace on the second surface of the substrate, wherein the third conductive trace includes a first branch and a second branch;

a conductive via extending through a thickness of the substrate and contacting the first branch of the third conductive trace on the second surface of the substrate and the second conductive trace on the first surface of the substrate; and one or more ground plane structures having irregular shapes on the second surface of the substrate.

2. The aperture feed network of claim 1, wherein the one or more ground plane structures are substantially aligned on the opposite side of the substrate from the first conductive trace and the second conductive trace.

3. The aperture feed network of claim 1, further comprising one or more striplines on the second surface of the substrate, the one or more striplines being adjacent to the one or more ground plane structures.

4. The aperture feed network of claim 3, wherein the one or more ground plane structures are provided between at least two of the striplines.

5. The aperture feed network of claim 3, wherein at least one of the one or more striplines is coupled to a resistor.

6. The aperture feed network of claim 1, wherein a portion of the second branch of the third conductive trace is substantially aligned on the opposite side of the substrate from the first conductive trace.

7. The aperture feed network of claim 1, wherein the differential signal line is configured to feed into an antenna.

8. The aperture feed network of claim 1, further comprising a first wing structure and a second wing structure patterned on the first surface of the substrate.

9. An RF system, comprising:

one or more antennas;

an aperture feed network electrically coupled to the one or more antennas, the aperture feed network including a substrate having a first surface and a second surface, the substrate comprising a dielectric material, wherein the second surface of the substrate is opposite and parallel to the first surface of the substrate, a first conductive trace on the first surface of the substrate, and a second conductive trace on the first surface of the substrate, wherein the first conductive trace and the second conductive trace together form a differential signal line, a third conductive trace on the second surface of the substrate, wherein the third conductive trace includes a first branch and a second branch, a conductive via extending through a thickness of the substrate and contacting the first branch of the third conductive trace on the second surface of the substrate and the second conductive trace on the first surface of the substrate, and one or more ground plane structures having irregular shapes on the second surface of the substrate; and a RF circuitry configured to one of or both filter and amplify an RF signal, wherein either the RF signal is received by the RF circuitry from the one or more antennas via the aperture feed network, or the filtered and/or amplified version of the RF signal is provided by the RF circuitry to the one or more antennas via the aperture feed network.

10. The RF system of claim 9, wherein the differential signal line is coupled to the one or more antennas and the third conductive trace is coupled to the RF circuitry.

11. The RF system of claim 9, wherein the one or more ground plane structures are substantially aligned on the opposite side of the substrate from the first conductive trace and the second conductive trace.

12. The RF system of claim 9, further comprising one or more striplines on the second surface of the substrate, the one or more striplines being adjacent to the one or more ground plane structures.

13. The RF system of claim 12, wherein the one or more ground plane structures are provided between at least two of the striplines.

14. The RF system of claim 12, wherein at least one of the one or more striplines is coupled to a resistor.

15. The RF system of claim 9, wherein a portion of the second branch of the third conductive trace is substantially aligned on the opposite side of the substrate from the first conductive trace.

16. An impedance matching structure, comprising:

a first conductive trace on a first surface of a substrate, and a second conductive trace on the first surface of the substrate, wherein the first conductive trace and the second conductive trace together form a differential signal line;

a third conductive trace on a second surface of the substrate opposite to the first surface of the substrate, wherein the third conductive trace includes a first branch and a second branch;

a conductive via extending through a thickness of the substrate and contacting the first branch of the third conductive trace on the second surface of the substrate and the second conductive trace on the first surface of the substrate;

one or more ground plane structures having irregular shapes on the second surface of the substrate; and one or more striplines on the second surface of the substrate, the one or more striplines being adjacent to the one or more ground plane structures.

17. The impedance matching structure of claim 16, wherein the one or more ground plane structures are substantially aligned on the opposite side of the substrate from the first conductive trace and the second conductive trace.

18. The impedance matching structure of claim 16, wherein the one or more ground plane structures are provided between at least two of the striplines.

19. The impedance matching structure of claim 16, wherein at least one of the one or more striplines is coupled to a resistor.

20. The impedance matching structure of claim 16, wherein a portion of the second branch of the third conductive trace is substantially aligned on the opposite side of the substrate from the first conductive trace.

* * * * *